US009002224B2

(12) United States Patent
Motomura

(10) Patent No.: US 9,002,224 B2
(45) Date of Patent: Apr. 7, 2015

(54) IMAGE FORMATION DEVICE AND IMAGE FORMATION PROGRAM

(71) Applicant: Oki Data Corporation, Tokyo (JP)

(72) Inventor: Mikio Motomura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 105 days.

(21) Appl. No.: 13/847,500

(22) Filed: Mar. 20, 2013

(65) Prior Publication Data

US 2013/0259502 A1 Oct. 3, 2013

(30) Foreign Application Priority Data

Mar. 29, 2012 (JP) ..... 2012-078315

(51) Int. Cl.
*G03G 15/02* (2006.01)
*G03G 15/16* (2006.01)

(52) U.S. Cl.
CPC ..... *G03G 15/0266* (2013.01); *G03G 15/1645* (2013.01)

(58) Field of Classification Search
CPC .... G03G 15/0266; G03G 15/02; G03G 15/16
USPC ..... 399/50, 66, 46
See application file for complete search history.

(56) References Cited

U.S. PATENT DOCUMENTS 6,782,215 B2 * 8/2004 Komori ..... 399/50
2009/0028591 A1 * 1/2009 Kubo ..... 399/50
2010/0111550 A1 * 5/2010 Kubo ..... 399/50

FOREIGN PATENT DOCUMENTS

JP 2000-206765 A 7/2000

* cited by examiner

*Primary Examiner* — Sophia S Chen
(74) *Attorney, Agent, or Firm* — Mark A. Motsenbocker; Mots Law, PLLC

(57) ABSTRACT

An image formation device for forming an image by an electrophotographic process includes a charge voltage controller configured to control an application charge voltage to be applied to a charge member, a transfer voltage controller configured to control a transfer voltage to be applied to a transfer member, a charge current detector configured to detect a charge current flowing through the charge member, and a controller configured to determine the application charge voltage according to the application charge voltage and the detected charge current, both detected when the transfer voltage controller applies a predetermined transfer voltage.

12 Claims, 15 Drawing Sheets

FIG.6

| | Vtr1 | Vtr2 |
|---|---|---|
| Vch1 | Ich(1 , 1), Itr(1 , 1) | Ich(1 , 2), Itr(1 , 2) |
| Vch2 | Ich(2 , 1), Itr(2 , 1) | Ich(2 , 2), Itr(2 , 2) |
| | EQUATION 1 | EQUATION 2 |
| | CALCULATE Vth1 | CALCULATE Vth2 |

FIG.11

| | APPLICATION CHARGE VOLTAGE Vch | CHARGE POTENTIAL OF PHOTOSENSITIVE DRUM DURING PRINTING (Vd) | DIFFERENCE FROM TARGET POTENTIAL (-600 V) |
|---|---|---|---|
| EXAMPLE | −1174(V) | −595(V) | −5V |
| COMPARATIVE EXAMPLE | −1140(V) | −561(V) | −39V |

FIG.15

| ENVIRONMENT | FILM THICKNESS | | Vch0 | Vth0 | CORRECTION RANGE | Vch | ACTUAL POTENTIAL Vd | DIFFERENCE FROM Vd0 (-600 V) |
|---|---|---|---|---|---|---|---|---|
| HH | 22 μm | EXAMPLE | −1100 | −500 | −20 | −1120 | −611 | +11 |
| | | COMPARATIVE EXAMPLE | −1100 | −500 | +49 | −1051 | −542 | −58 |
| | 14 μm | EXAMPLE | −1100 | −500 | +118 | −982 | −590 | −10 |
| | | COMPARATIVE EXAMPLE | −1100 | −500 | +155 | −945 | −553 | −47 |
| NN | 22 μm | EXAMPLE | −1150 | −550 | −24 | −1174 | −595 | −5 |
| | | COMPARATIVE EXAMPLE | −1150 | −550 | +10 | −1140 | −561 | −39 |
| | 14 μm | EXAMPLE | −1150 | −550 | +56 | −1094 | −605 | +5 |
| | | COMPARATIVE EXAMPLE | −1150 | −550 | +86 | −1064 | −575 | −25 |
| LL | 22 μm | EXAMPLE | −1200 | −600 | −10 | −1210 | −588 | −12 |
| | | COMPARATIVE EXAMPLE | −1200 | −600 | +31 | −1169 | −547 | −53 |
| | 14 μm | EXAMPLE | −1200 | −600 | +72 | −1128 | −603 | +3 |
| | | COMPARATIVE EXAMPLE | −1200 | −600 | +94 | −1106 | −581 | −19 |

IMAGE FORMATION DEVICE AND IMAGE FORMATION PROGRAM

CROSS REFERENCE TO RELATED APPLICATIONS

This application claims priority based on 35 USC 119 from prior Japanese Patent Application No. 2012-078315 filed on Mar. 29, 2012, entitled "IMAGE FORMATION DEVICE AND IMAGE FORMATION PROGRAM", the entire contents of which are incorporated herein by reference.

BACKGROUND OF THE INVENTION

1. Field of the Invention

The disclosure relates to an image formation device configured to form images by use of an electrophotographic process, and an image formation program causing a computer to execute functions of the image formation device.

Heretofore, an image formation device such as a printer, a copying machine, a multifunction device, and a facsimile includes a photosensitive drum, and forms an image on a recording medium through an electrophotographic process including the steps of charging, exposing, developing, transferring, and fixing. To be more precise, the image formation device prints or forms an image on a sheet by repeating, as a print process, the steps of: uniformly charging a surface of the photosensitive drum with a charge device; forming an electrostatic latent image by exposing, with an exposure device, the surface of the photosensitive drum charged in the charging step; developing, with a development device, the electrostatic latent image formed in the exposing step to thereby form a toner image; transferring, with a transfer device, the toner image developed in the developing step onto a sheet (recording medium) or the like on which the image is to be transferred; fixing the toner image by heating and pressing the sheet onto which the image is transferred; cleaning the surface of the photosensitive drum after the transferring step; and discharging the surface of the photosensitive drum. In the charging step of this process, recently-developed image formation devices are configured to apply a DC voltage to a charge roller in pressure contact with the photosensitive drum, and uniformly charge the photosensitive drum by charge injection from a microdischarge occurring between the charge roller and the photosensitive drum.

For example, an image formation device described in Japanese Patent Application Publication No. 2000-206765 is configured in the following manner. Specifically, when applying a charge starting voltage to a photosensitive drum before starting the printing, the image formation device compares the charge starting voltage with a reference charge starting voltage that is a charge starting voltage in a reference state, selects an appropriate application voltage and applies the voltage to a charge roller. By thus adjusting the voltage applied to the charge roller depending on the desired charge starting voltage, the image formation device can charge the photosensitive drum with an optimal potential under various environmental conditions. Accordingly, the image formation device can form an image having no color phase irregularity on a recording medium, and thus can provide stable print quality. Here, a charge starting voltage refers to a charge voltage applied to the charge roller when charging of the photosensitive drum starts while the charge voltage is gradually increased.

SUMMARY OF THE INVENTION

However, in the technique of Japanese Patent Application Publication No. 2000-206765, unless the image formation device maintains the optimal charge potential on the surface of the photosensitive drum during the charging step (from when the surface of the photosensitive drum is charged by the charge roller until immediately before the surface is exposed by the exposure device), an image formed on a recording medium (called a print image below) may have problems such as a variation in density of the print image, or toner being transferred onto portions which originally should be blank.

Even though a predetermined DC voltage may be applied to a charge roller, a general image formation device cannot maintain the optimal charge potential on the surface of a photosensitive drum, if no other measures are taken, due to factors such as environmental conditions and the surface conditions of the photosensitive drum. For example, in such an image formation device, applying a predetermined voltage to the charge roller alone increases the impedance of the charge roller when in a low-temperature and low-humidity environment, whereby the amount of charge injection by a microdischarge from the charge roller to the surface of the photosensitive drum is reduced. Consequently, the charge potential of the surface of the photosensitive drum becomes lower than a desired level (optimal charge potential). In contrast, installing the image formation device under a high-temperature and high-humidity environment decreases the impedance of the charge roller. Consequently, the charge potential of the surface of the photosensitive drum becomes higher than a desired level (optimal charge potential).

Moreover, in a general image formation device, when a photosensitive layer forming a surface layer of the photosensitive drum wears thin in film thickness, a capacitance of the surface layer increases. Hence, it is necessary to increase the amount of charge injection to obtain the same charge potential. For this reason, if the voltage applied to the charge roller is kept constant, the charge potential of the surface of the photosensitive drum is lowered along with the reduction in film thickness of the photosensitive layer by wear, and problems may occur in the print image.

Thus, as a method of appropriately determining a DC voltage to be applied to the charge roller, there is proposed a method of determining the charge voltage to be applied to the charge roller by calculating a charge starting voltage at which a microdischarge is started between the photosensitive drum and the charge roller, and then adding a target surface potential of the photosensitive drum to the calculated voltage. However, such a method of calculating the charge starting voltage does not take into account a transfer voltage to be applied to the transfer roller. Accordingly, such a method of calculating the charge starting voltage lacks accuracy in the charge starting voltage, and may lead to a problem in that the actual surface potential of the photosensitive drum does not become the target surface potential.

Embodiments of the invention aim to provide an image formation device capable of determining a charge voltage to be applied to a charge roller while taking into account a transfer voltage, and an image formation program causing a computer to execute functions of the image formation device.

A first aspect of the invention is an image formation device for forming an image by an electrophotographic process forming a latent image on a surface of a photoreceptor charged by a charge member, attaching a developer to the latent image on the surface of the photoreceptor to form the developer image, and then transferring the developer image from the photoreceptor to a medium. The image formation device comprises: a charge voltage controller configured to control an application charge voltage to be applied to the charge member; a transfer voltage controller configured to control a transfer voltage to be applied to the transfer member; a charge current detector configured to detect a charge current flowing through the charge member; and a controller configured to determine the application charge voltage according to the application charge voltage and the detected charge current both detected when the transfer voltage controller applies a predetermined transfer voltage.

A second aspect of the invention is an image formation program causing a computer of an image formation device to form an image according to an electrophotographic process. The image formation device includes a photoreceptor, a charge member, an exposure unit, a development unit, a transfer member, a charge voltage controller configured to control an application charge voltage to be applied to the charge member, a transfer voltage controller configured to control a transfer voltage to be applied to the transfer member, and a charge current detector configured to detect a charge current flowing through the charge member. The program causes the computer to execute: a first charge starting voltage estimation step of estimating a first charge starting voltage which is an application charge voltage at which a charge current flowing through the charge member is lowered to zero in the case where the transfer voltage is a first voltage; a second charge starting voltage estimation step of estimating a second charge starting voltage which is an application charge voltage at which a charge current flowing through the charge member is lowered to zero in the case where the transfer voltage is a second voltage; and an application charge voltage determination step of determining an application charge voltage to be applied to the charge member by adding up the first charge starting voltage, a target charge potential of the photoreceptor, and a difference between the first and second charge starting voltages.

A third aspect of the invention is an image formation program causing a computer of an image formation device to form an image according to an electrophotographic process. The image formation device includes a photoreceptor, a charge member, an exposure unit, a development unit, a transfer member, a charge voltage controller configured to control an application charge voltage to be applied to the charge member, a transfer voltage controller configured to control a transfer voltage to be applied to the transfer member, a charge current detector configured to detect a charge current flowing through the charge member, and a transfer current detector configured to detect a current flowing through the transfer member. The program causes the computer to execute: a first step of detecting a value of a current flowing through the charge member when a predetermined DC voltage is applied to the charge member; a second step of detecting a value of a current flowing through the transfer member when a predetermined DC voltage is applied to the transfer member; and a third step of controlling a DC voltage to be applied to the charge member when forming an image, according to the value of the current flowing through the charge member and the value of the current flowing through the transfer member.

According to the aspects described above, it is possible to determine the charge voltage to be applied to the charge roller while taking into account the transfer voltage. Thus, a variation in density does not occur in the print image, and toner is not transferred onto portions which should be blank. As a result, favorable quality of the print images can be maintained.

BRIEF DESCRIPTION OF THE DRAWINGS

FIG. 6 is an explanatory view showing how to calculate charge starting voltages of the image formation device according to the first embodiment.

FIG. 11 is an explanatory view showing a difference between calculations of the charge starting voltages of the image formation device according to the first embodiment and of the image formation device of a comparative example.

FIG. 15 is an explanatory view showing a difference between corrections of the application charge voltages of the image formation device according to the second embodiment and of an image formation device according to a comparative example.

DETAILED DESCRIPTION OF EMBODIMENTS

Figure 1:
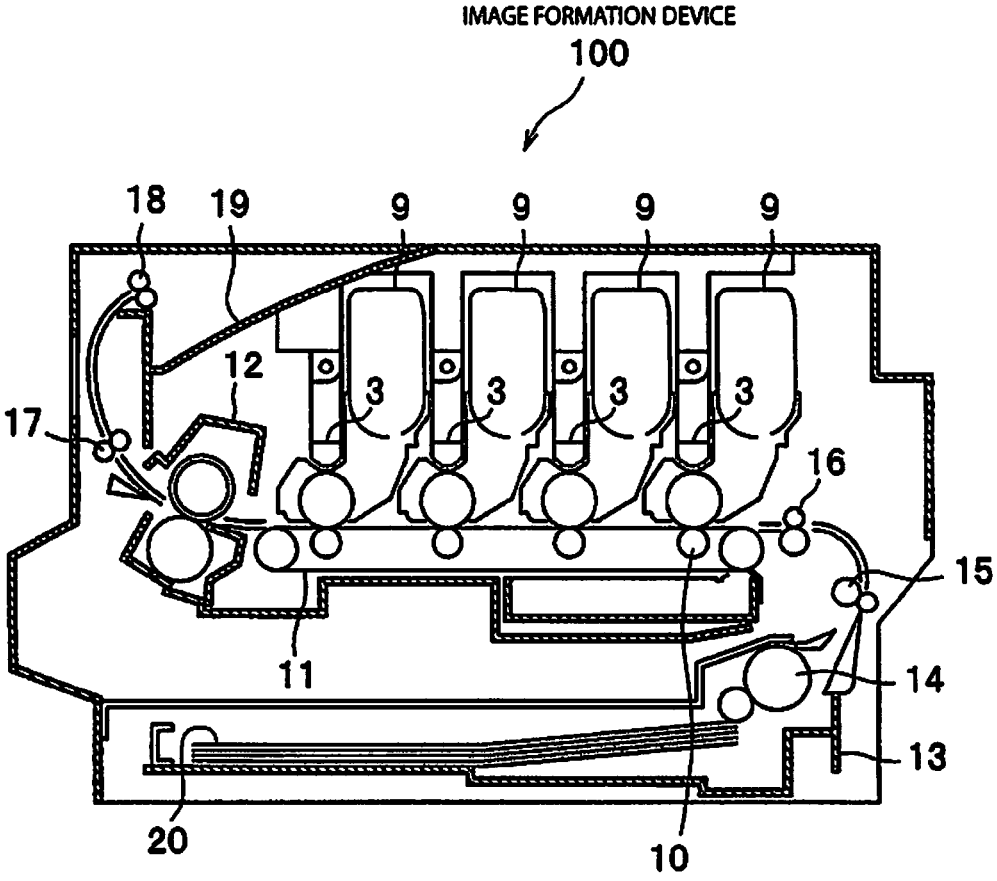
FIG. 1 is a longitudinal section (schematic) of an image formation device according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

<Outline>

Firstly, an outline of the invention is described with reference to FIGS. 3, 9, and 10.

In general, to form a high-quality print image, an image formation device needs to determine an application charge voltage of higher accuracy, and to perform optimal control of the surface potential of a photosensitive drum. Hence, after applying at least two DC voltages (application charge voltage) having different voltage values to charge member 2 (charge roller 2), image formation device 100 detects two current values flowing from charge member 2 to photosensitive drum 1. Then, according to detected results of two current values flowing from charge member 2 to photosensitive drum 1 and two current values flowing from transfer member 10 to photosensitive drum 1, image formation device 100 performs optimal control of the voltage applied to charge member 2. At this time, when the transfer voltage is fixed (the transfer voltage is fixed to zero in the following embodiments), CPU 37 calculates an impedance from the difference between the application charge voltages and the difference between the charge currents. Next, by using the calculated impedance, CPU 37 gradually lowers the application charge voltage and calculates an application charge voltage Vth (first charge starting voltage) at which the charge current flowing through charge roller 2 becomes equal to zero (see FIG. 9). Then, based on a variation of the charge current caused by the variation of the transfer voltage (transfer voltage is varied to 2500 V in the following embodiments), CPU 37 calculates a charge starting voltage Vth (second charge starting voltage) in the case of applying the transfer voltage to transfer roller 10. Subsequently, CPU 37 calculates an application charge voltage (see FIG. 10) by adding a variation of the charge starting voltage (a difference between the second charge starting voltage and the first charge starting voltage) to a first application charge voltage (application charge voltage of a general image formation device). The application charge voltage is the sum of the first charge starting voltage and a target charge potential value (e.g., −600 V) of photosensitive drum 1. CPU 37 can also calculate the application charge voltage by adding the target charge potential to the second charge starting voltage. Thus, image formation device 100 can perform optimal control of the surface potential of photosensitive drum 1, whereby problems such as a variation in density and smudges on the print image can be prevented. Consequently, it is possible to stably maintain favorable print quality. Here, a charge potential refers to a surface potential of photosensitive drum 1 from a charge region to immediately before an exposure region.

Hereinafter, a detailed description is given of embodiments of the invention with reference to the drawings. Note that the drawings only show the invention schematically. However, the invention is not limited to the examples shown in the drawings. In the drawings, common or similar components are assigned the same reference numerals, and redundant descriptions are omitted.

<First Embodiment>

[Configuration of Image Formation Device According to a First Embodiment]

Image formation device 100 according to a first embodiment is a printer, a copying machine, a facsimile, or a multifunctional device including a printer unit and a scanner unit, for example. The embodiment is described by assuming that image formation device 100 is a color printer.

FIG. 1 is a longitudinal section (schematic) of the image formation device according to the first embodiment. Image formation device 100 in FIG. 1 includes exposure LED heads 3, image formation units 9, transfer rollers 10, transfer belt 11, fixing unit 12, feeder cassette 13, feeder roller 14, transfer rollers 15, 16, 17, ejection roller 18, and stacker 19.

Recording medium 20 housed in feeder cassette 13 is sent out by feeder roller 14, transferred along a conveyance path formed of transfer rollers 15, 16, 17, ejection roller 18, and transfer belt 11, and then ejected outside to be stacked on stacker 19. In image formation device 100, four image formation units 9 are arranged along the conveyance path at positions facing transfer rollers 10, with transfer belt 11 in-between. Moreover, fixing unit 12 which fixes toner 22 to recording medium 20 is provided downstream of the four image formation units 9.

Figure 2:
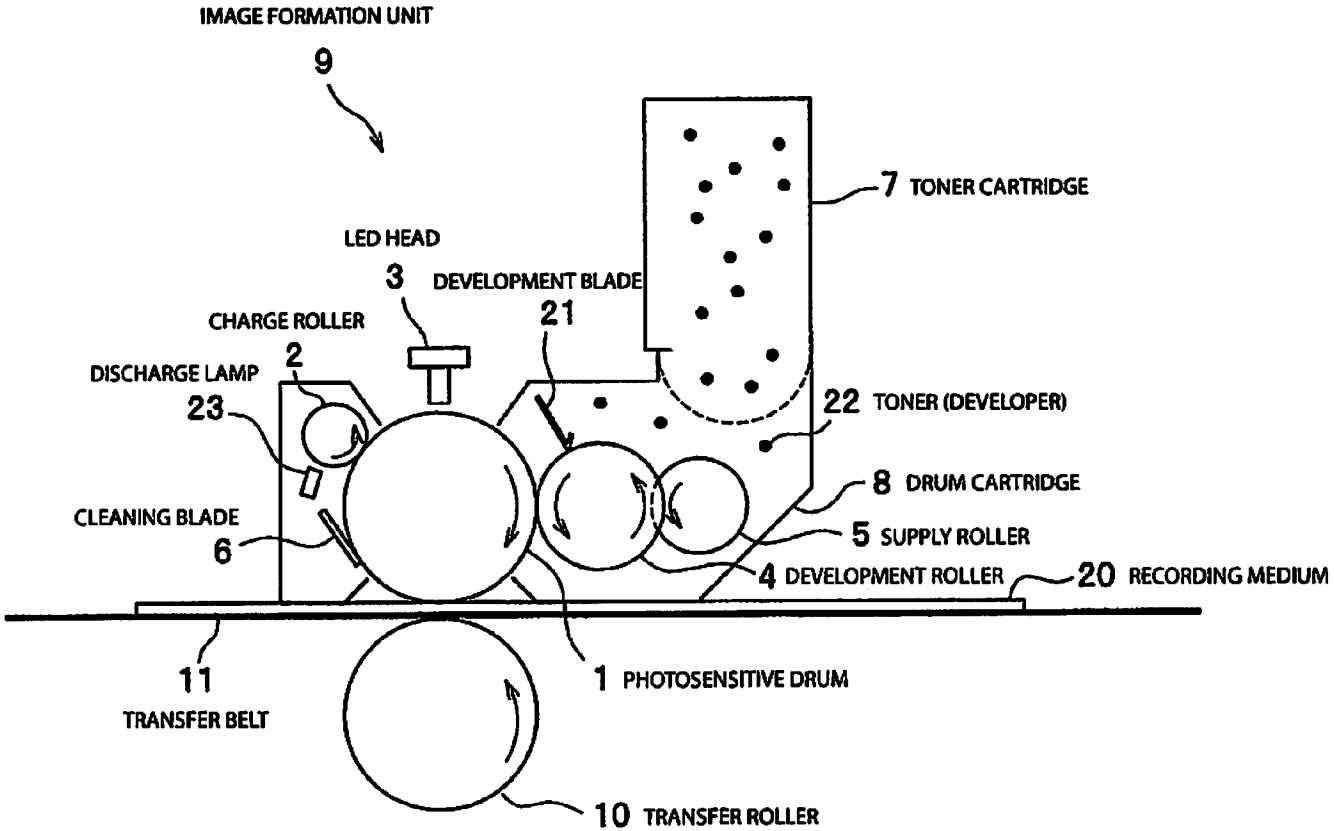
FIG. 2 is a longitudinal section (schematic) of an image formation unit according to the first embodiment.

FIG. 2 is a configuration diagram of image formation unit 9. Exposure LED head 3 as an exposure unit is also shown in FIG. 2.

Image formation unit 9 includes photosensitive drum 1 as an image carrier, charge roller 2 as a charge member, development roller 4 as a developer carrier, supply roller 5 as a developer supply unit, cleaning blade 6, toner cartridge 7, and development blade 21 as a thin-layer formation unit.

Toner cartridge 7 is filled with toner 22 as a developer, and is detachable from a main body portion. As is described later, toner 22 is made through a grinding process in which a mixture of a binding resin, a charge control material, a colorant, and a parting agent is subjected to hot-melt kneading and then grinding. Toner 22 is made of a base toner (made of resin and wax) and an additive such as silica and a metallic oxide added around the base toner. The additive is added to prevent toner 22 from directly attaching to other members such as by forming a collar when toner 22 comes into contact with another toner 22 or with a surface of the development roller. Note that the additive is bound with the base toner with the van der Waals force or the like.

Supply roller 5 is a roller for supplying toner 22 fallen from toner cartridge 7 to development roller 4, and is also called a sponge roller. Development blade 21 is formed of a metal sheet with a bent tip end, and smooths toner 22 supplied on the surface of development roller 4 into a thin layer. Development roller 4 transfers toner 22 onto the electrostatic latent image formed on photosensitive drum 1 due to the effect of an electric field. Note that toner 22 having fallen from toner cartridge 7 also exists around supply roller 5.

Meanwhile, charge roller 2 uniformly charges the surface of photosensitive drum 1 to a negative polarity. Photosensitive drum 1 is an aluminum element tube on which a photosensitive layer (photoconductive insulating layer) made of an organic compound is formed, and which has an external diameter of ϕ30 mm. The photosensitive layer of photosensitive drum 1 has a property of an insulator when not subjected to light, and becomes conductive to have a property of allowing charged particles to pass therethrough when subjected to light. When irradiated with light from exposure LED head 3, the negatively charged surface layer of photosensitive drum 1 is discharged and an electrostatic latent image is formed thereon. At this time, photosensitive drum 1 charged to have a surface potential of −600 V, for example, is discharged to have a latent image potential of −40 V. Then, development roller 4 develops the electrostatic latent image on photosensitive drum 1 to form a toner image as a developer image. For example, −200 V is applied to development roller 4, and the negatively charged toner 22 at −40 V is transferred to the electrostatic latent image, attaches thereto, and visualizes the electrostatic latent image.

Figure 3:
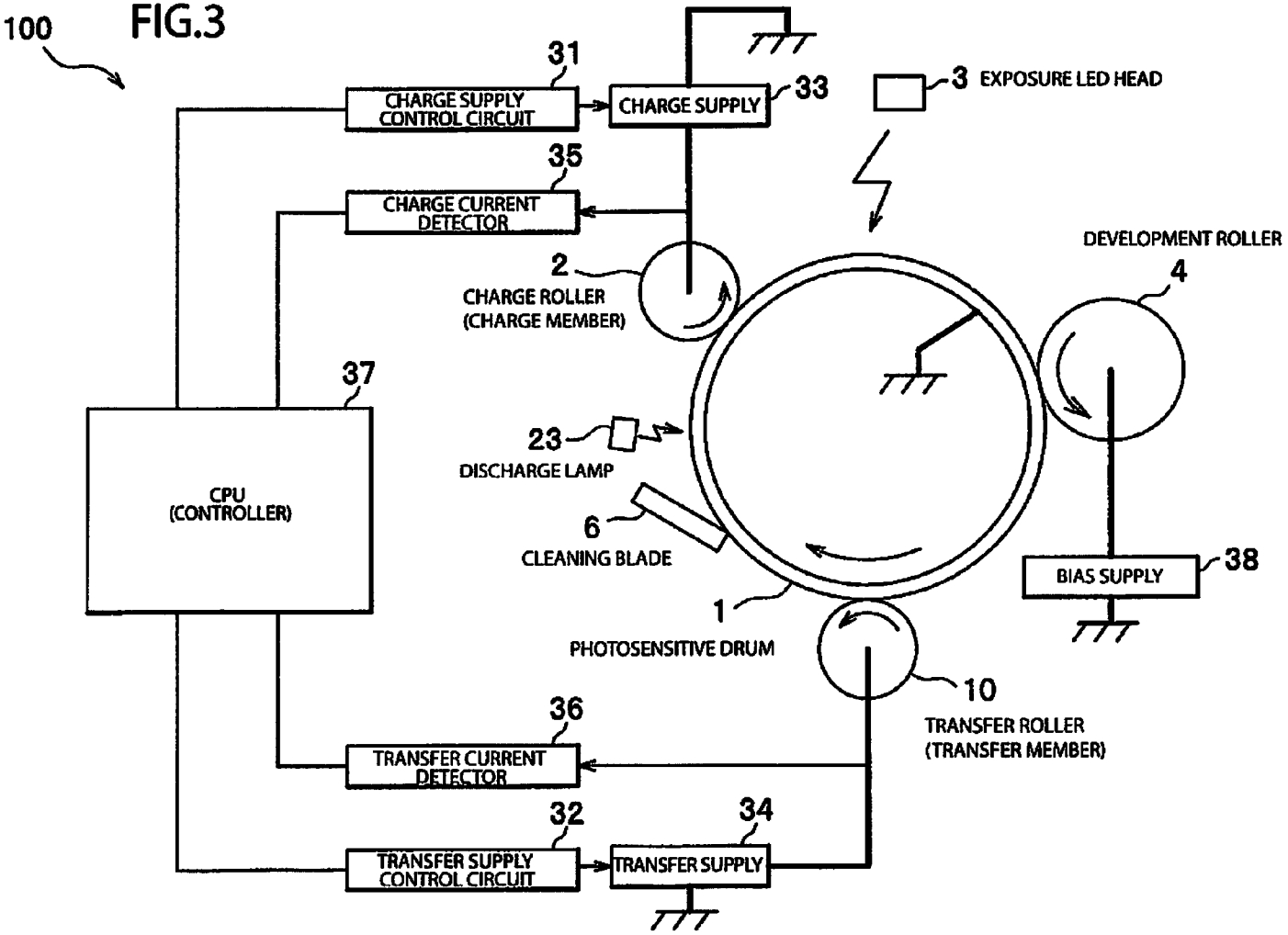
FIG. 3 is a block diagram showing a functional configuration of a charge/transfer portion of the photosensitive drum shown in FIG. 1.

FIG. 3 is a block diagram showing a functional configuration of a charge/transfer portion of photosensitive drum 1 shown in FIG. 1. As shown in FIG. 3, photosensitive drum 1 is, for example, a cylindrical OPC (Organic Photoconductor) drum having a diameter of 30 mm, made by arranging a photosensitive layer with a 22 μm thickness on a surface of a cylindrical element pipe, and is driven to rotate about the center of the cylindrical element pipe in the direction indicated by an arrow in FIG. 3. Note that a metal surface inside photosensitive drum 1 is grounded.

Charge roller 2 as the charge member is in pressure contact with the surface of photosensitive drum 1, and is configured to rotate along with the rotation of photosensitive drum 1. Note that charge supply 33 controlled by charge supply control circuit 31 according to instructions of CPU (Central Processing Unit) 37 applies a predetermined charge voltage to charge roller 2. Moreover, charge current detector 35 has a function of detecting the charge current flowing from charge supply 33 to charge roller 2. Exposure LED head 3 forms an electrostatic latent image on the surface of the photosensitive drum charged by charge roller 2.

Toner 22 supplied by supply roller 5 (FIG. 2) is applied in a uniform thickness by development blade 21 (FIG. 2) on the surface of development roller 4. Toner 22 on the surface of development roller 4 is charged by a bias voltage (e.g., −250 V) from bias supply 38, and is thereby stably attached to the surface of development roller 4. Supply roller 5 and developer roller 4 are housed in a drum cartridge 8. At a portion where the surface of development roller 4 comes into contact with (comes close to) the surface of photosensitive drum 1 with the rotation of development roller 4, toner 22 attached to the surface of development roller 4 is transferred, due to the effect of an electric field, onto the electrostatic latent image formed on photosensitive drum 1. For example, negatively charged toner 22 attached on the surface of development roller 4 and charged to −250 V by a bias voltage is transferred onto the −40 V electrostatic latent image formed on photosensitive drum 1. Thus, the electrostatic latent image is developed and a toner image is formed on the surface of photosensitive drum 1.

Transfer roller 10 as a transfer member faces photosensitive drum 1 with transfer belt 11 and recording medium 20 (FIG. 2) in-between. Transfer roller 10 rotates and transfers the toner image formed on the surface of photosensitive drum 1 onto recording medium 20. Moreover, transfer supply 34 controlled by transfer supply control circuit 32 according to instructions of CPU 37 applies a predetermined transfer voltage to transfer roller 10. In addition, transfer current detector 36 has a function of detecting a transfer current flowing from transfer supply 34 to transfer roller 10.

Cleaning blade 6 is formed of a rubber member as an elastic body, and scrapes off the toner image, which is left without being transferred onto the sheet, from photosensitive drum 1. Discharge lamp 23 irradiates the surface of photosensitive drum 1 with light of a predetermined wavelength, and can discharge the surface of photosensitive drum 1 unless the surface potential has a polarity reversed to that of the charge potential due to the transfer current. Discharge lamp 23 performs a discharge even when the transfer voltage is 0 V.

CPU 37 as a controller is directly connected with, and controls, charge supply control circuit 31, transfer supply control circuit 32, charge current detector 35, and transfer current detector 36. Moreover, charge supply control circuit 31 is connected with charge supply 33, and transfer supply control circuit 32 is connected with transfer supply 34. Hence, CPU 37 controls charge supply control circuit 31 to control the voltage value to be applied from charge supply 33 to charge roller 2. In addition, CPU 37 controls transfer supply control circuit 32 to control the voltage value to be applied from transfer supply 34 to transfer roller 10. CPU 37 also has a function of calculating an optimal charge voltage value to be applied to charge roller 2 and feeding it back to charge supply control circuit 31. CPU 37 calculates this charge voltage on the basis of a charge current flowing from charge supply 33 to charge roller 2 detected by charge current detector 35, and a transfer current flowing from transfer supply 34 to transfer roller 10 detected by transfer current detector 36.

CPU 37 also has a function of calculating a DC voltage to be applied to charge roller 2. CPU 37 calculates this DC voltage on the basis of a current value detected by charge current detector 35 when voltage is applied to charge roller 2, and a current value detected by transfer current detector 36 when voltage is applied to transfer roller 10. Moreover, CPU 37 also has a function of correcting a preset voltage to be applied to charge roller 2. CPU 37 performs this correction on the basis of a current value detected by charge current detector 35 when voltage is applied to charge roller 2, and a current value detected by transfer current detector 36 when voltage is applied to transfer roller 10.

[Operation of Image Formation Device 100]

Figure 4:
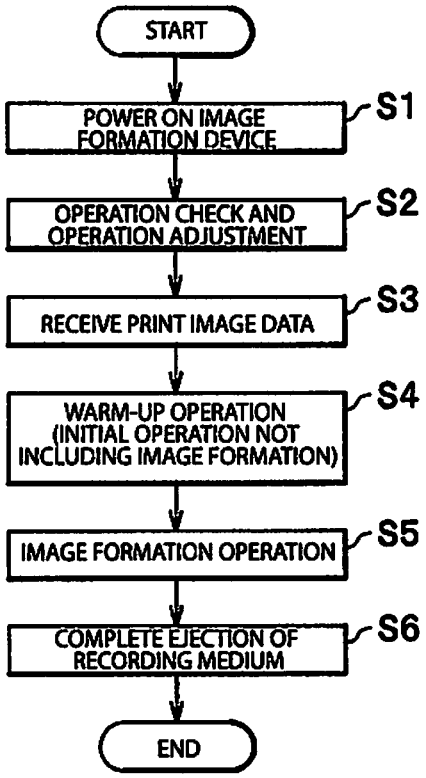
FIG. 4 is a flowchart showing a flow of an image formation operation of the image formation device according to the first embodiment.

Next, a description is given of an image formation operation performed by image formation device 100 of the first embodiment shown in FIG. 1. FIG. 4 is a flowchart showing a flow of the image formation operation of image formation device 100 according to the first embodiment.

As shown in FIG. 4, image formation device 100 of the first embodiment is started by being powered on by a user (step S1). Then, image formation device 100 performs an operation check and an operation adjustment (step S2). For example, image formation device 100 checks whether or not image formation units 9 (see FIG. 1) necessary for image formation are installed in predetermined positions, and performs checks and adjustments on whether or not components such as sensors and motors are operating normally.

Figure 5:
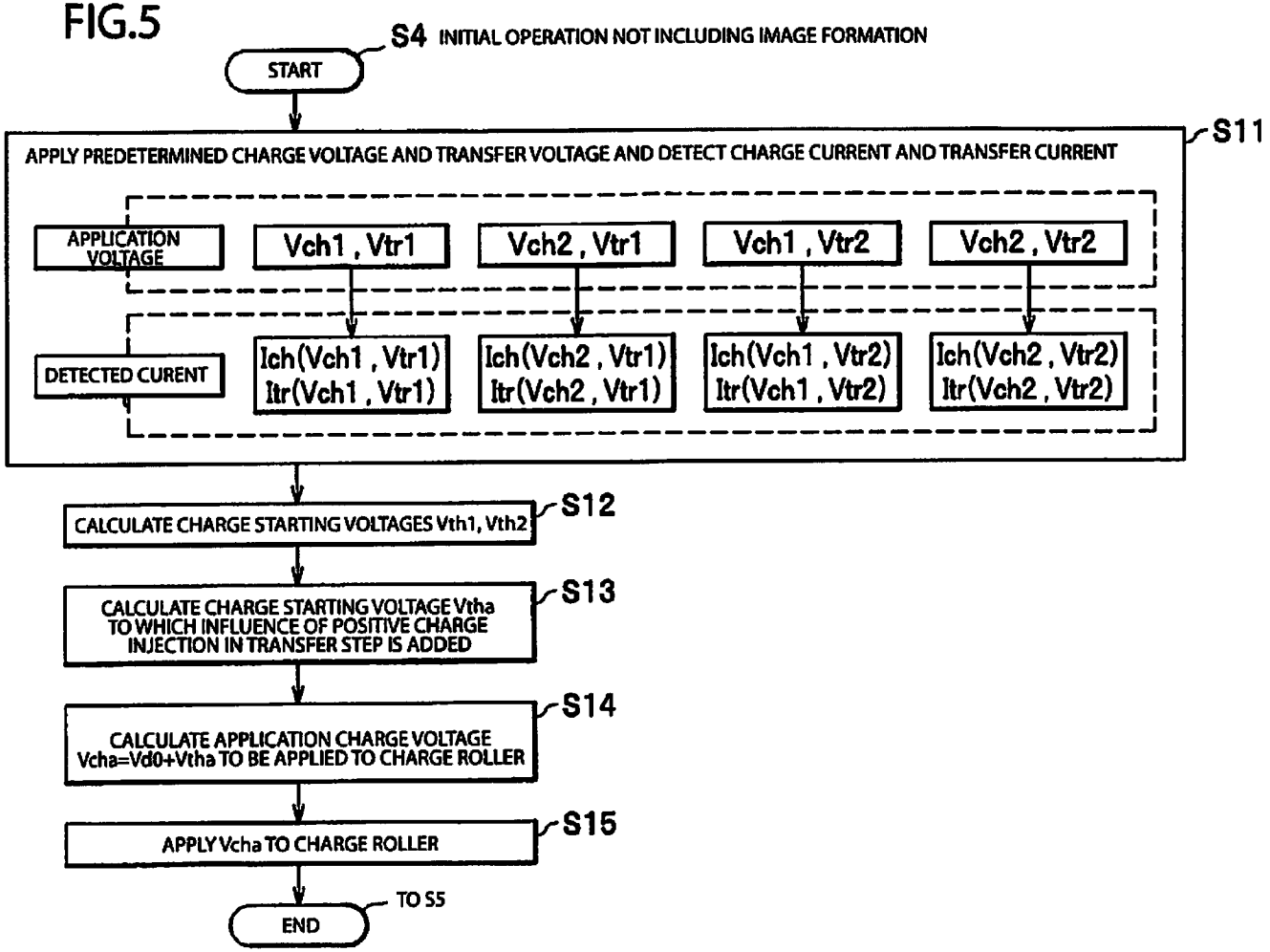
FIG. 5 is a flowchart showing a flow of an initial operation of an application charge voltage of the image formation device according to the first embodiment.

Next, image formation device 100 receives an image formation instruction and print image data from an external device such as a PC (Personal Computer) (step S3). Then, before performing the image formation operation, image formation device 100 performs a warm-up operation as a previous step (step S4). In this warm-up operation, image formation unit 9 shown in FIG. 2 performs an initial operation not including image formation (FIG. 5). Then, image formation device 100 calculates an optimal charge voltage to be applied to charge roller 2, as a charge member, in order to charge photosensitive drum 1 to an optimal charge potential. Details of the operation of image formation device 100 for calculating the optimal application charge voltage is described later. After performing this warm-up operation, a surface potential Vd of photosensitive drum 1 reaches a target charge potential Vd0.

Next, image formation device 100 performs the image formation operation (step S5). In this image formation operation, recording medium 20 sent out from feeder cassette 13 is transferred to image formation units 9, and toner images are transferred onto the surface thereof by image formation units 9 of respective colors (K, Y, M, and C) so as to form an image.

At the time of the operation in step S5, image formation device 100 repeats the sequential steps of the print process. Image formation unit 9 of each color shown in FIGS. 1 and 2 performs a charge step in which: the surface of photosensitive drum 1 is uniformly charged to a negative potential by a charge roller 2 abutting photosensitive drum 1. Next, image formation unit 9 performs an exposure step in which: exposure LED head 3 irradiates photosensitive drum 1 with light according to the print image data received from the external device. Thus, an electrostatic latent image is formed on photosensitive drum 1. Further, image formation unit 9 performs a development step in which: toner 22 on development roller 4 is transferred onto the electrostatic latent image, and a toner image is formed on photosensitive drum 1. Then, image formation unit 9 performs a transfer step in which: the toner image formed on photosensitive drum 1 is transferred onto recording medium 20 by transfer roller 10 to which a positive transfer voltage is applied. Subsequently, image formation unit 9 performs a cleaning step and removes toner 22 attached to the surface of photosensitive drum 1 by using cleaning blade 6. Thereafter, image formation unit 9 performs a discharge step in which: discharge lamp 23 irradiates the surface of photosensitive drum 1 with light of a predetermined wavelength to discharge the surface. Image formation device 100 repeats the sequential steps of the print process described above.

After image formation device 100 repeats the steps of the print process, the toner image formed on recording medium 20 is fixed onto recording medium 20 in fixing unit 12. Then, as recording medium 20 is ejected onto stacker 19, the image formation operation is ended (step S6).

Next, a description is given of the initial operation, not including image formation, in the warm-up operation of image formation device 100 mentioned in step S4 of FIG. 4, in which image formation device 100 calculates the optimal charge voltage to be applied to charge roller 2. FIG. 5 is a flowchart showing a flow of the initial operation of an application charge voltage of the image formation device 100 according to the first embodiment. Note that although reference numerals of voltages and currents shown in the following description and in FIG. 5 and the following drawings are all absolute values, the symbol indicating the absolute value is omitted for convenience. For example, Vch1 is |Vch1|, and Ich is |Ich|.

Usually, during the initial operation, not including image formation, image formation device 100 does not perform exposure from exposure LED head 3 shown in FIG. 2 to photosensitive drum 1. Thus, no electrostatic latent image is formed on photosensitive drum 1. To form the toner image on photosensitive drum 1, a negative voltage of about −250 V is applied from bias supply 38 to development roller 4 (see FIG. 3).

However, according to Paschen's Law stating that a discharge occurs when a difference between the surface potential of charge roller 2 and the surface potential (charge potential) of photosensitive drum 1 exceeds a predetermined value, the application voltage is a voltage value sufficiently smaller than the estimated application voltage at which charge injection is started by the microdischarge. Hence, toner 22 is provided onto photosensitive drum 1 by developing, and the charge injection on photosensitive drum 1 by development roller 4 causes no influence. In image formation device 100, discharge lamp 23 emits a discharge light in the initial operation, not including image formation, as well. The surface of photosensitive drum 1 can be discharged unless the transfer current makes the surface potential have a positive polarity, which is reversed to the polarity of the charge potential applied by charge roller 2.

In the flowchart in FIG. 5, image formation device 100 starts the initial operation, not including image formation, according to the preconditions described above (processing of step S11). Firstly, charge supply 33 and transfer supply 34 respectively apply a predetermined charge voltage and a predetermined transfer voltage to charge roller 2 and transfer roller 10. Charge current detector 35 and transfer current detector 36 respectively detect the charge current and the transfer current (step S11). The processing of step S11 is next described. CPU 37 shown in FIG. 3 controls charge supply control circuit 31 such that charge supply 33 applies predetermined charge voltages (two application charge voltages Vch1, Vch2) to charge roller 2. CPU 37 also controls transfer supply control circuit 32 such that transfer supply 34 applies predetermined transfer voltages (two transfer voltages Vtr1, Vtr2) to transfer roller 10.

At this time, the application charge voltages Vch1, Vch2 are set to voltages larger in absolute value than the charge starting voltage (about −550 V in the first embodiment) in the normal state estimated from Paschen's Law. In image formation device 100 of the first embodiment, the application charge voltages are set such that Vch1 is −1000 V, and Vch2 is −1350 V.

Additionally, at this time, the transfer voltage Vtr1 is set to such a voltage that the surface potential of photosensitive drum 1 is not influenced, even if positive charges are directly injected from transfer roller 10 to photosensitive drum 1 in the transfer step. Meanwhile, the transfer voltage Vtr2 is set to such a voltage that the surface potential of photosensitive drum 1 is influenced by positive charges (indirectly) injected from transfer roller 10 to photosensitive drum 1 via recording medium 20 to which an image is transferred in the transfer step. In image formation device 100 of the first embodiment, the predetermined transfer voltages are set such that Vtr1 is 0 V, and Vtr2 is +2500 V.

Note that the influence of positive charge injection from transfer roller 10 in the transfer step is, for example, the surface potential of photosensitive drum 1 being positively charged before the charge step, i.e., immediately before photosensitive drum 1 is charged by charge roller 2.

Next, by use of charge current detector 35 and transfer current detector 36 shown in FIG. 3, image formation device 100 detects charge currents Ich (Vch1, Vtr1), Ich (Vch1, Vtr2), Ich (Vch2, Vtr1), Ich (Vch2, Vtr2), and transfer currents Itr (Vch1, Vtr1), Itr (Vch1, Vtr2), Itr (Vch2, Vtr1), Itr (Vch2, Vtr2) which flow under the respective combinations of two patterns of charge voltages (Vch1, Vch2) to be applied to charge roller 2 and two patterns of transfer voltages (Vtr1, Vtr2) of transfer roller 10. The above is the operation of step S11.

(Processing of Step S12)

Next, CPU 37 calculates charge starting voltages Vth1, Vth2 according to the detected charge current Ich and transfer current Itr (step S12). FIG. 6 is an explanatory view showing how to calculate a charge starting voltage in the first embodiment. The processing of step S12 is described with reference to FIGS. 3 and 6.

CPU 37 shown in FIG. 3 pairs a charge voltage value applied to charge roller 2 in step S11 with a transfer voltage value applied to transfer roller 10 in step S11, as shown in FIG. 6. Then, CPU 37 references the charge current Ich and transfer current Itr respectively detected by charge current detector 35 and transfer current detector 36 for each of combinations (Vch1, Vtr1), (Vch1, Vtr2), (Vch2, Vtr1), (Vch2, Vtr2), to thereby calculate the charge starting voltages Vth1, Vth2.

The calculation processing is described in further detail. CPU 37 calculates the charge starting voltages Vth1, Vth2, by assuming that the charge current Ich=0 and using Equations 1 and 2 which are relational expressions between the charge voltage Vch applied to charge roller 2 and the charge current Ich that flows through charge roller 2 at this time. Here, CPU 37 uses Equation 1 to calculate the charge starting voltage Vth1 which is the application charge voltage Vch when Ich=0, and uses Equation 2 to calculate the charge starting voltage Vth2 which is the application charge voltage Vch when Ich=0

$$Ich - Ich(Vch1, Vtr1) = \frac{Ich(Vch2, Vtr1) - Ich(Vch1, Vtr1)}{Vch2 - Vch1} \cdot (Vch - Vch1) \quad (1)$$

$$Ich - Ich(Vch1, Vtr2) = \frac{Ich(Vch2, Vtr2) - Ich(Vch1, Vtr2)}{Vch2 - Vch1} \cdot (Vch - Vch1) \quad (2)$$

Figure 7:
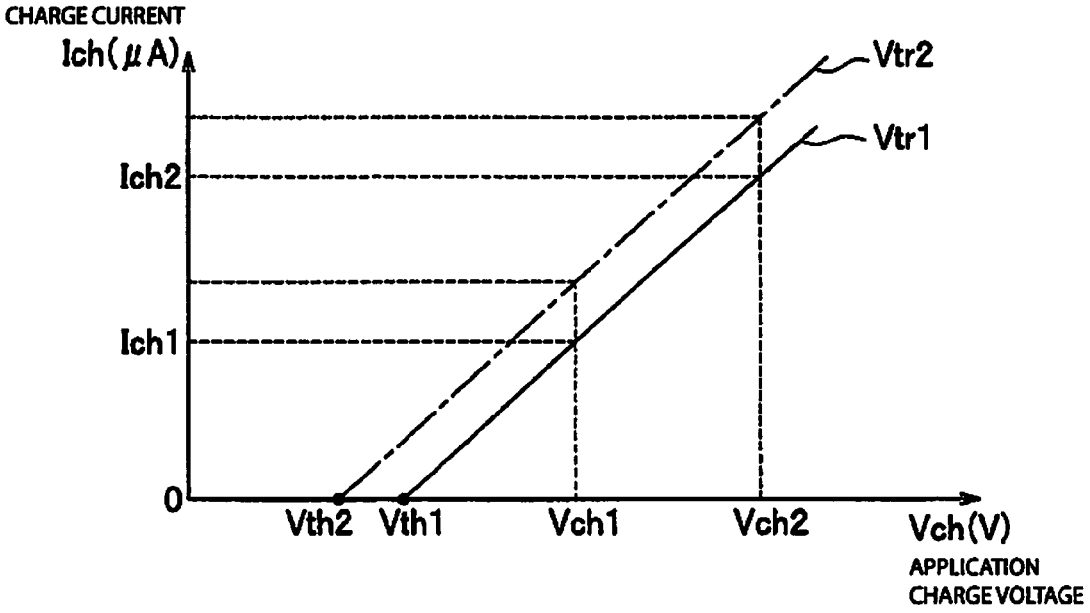
FIG. 7 is an explanatory view showing a concept of calculating the charge starting voltages of the image formation device according to the first embodiment.

FIG. 7 is an explanatory view showing a concept of calculating the charge starting voltages in the first embodiment, where the abscissa indicates the application charge voltage Vch, and the ordinate indicates the charge current Ich. In other words, FIG. 7 shows a concept of calculating the charge starting voltages Vth1, Vth2 in the first embodiment. Since the charge starting voltage Vth1 calculated by Equation 1 is a voltage value calculated when the transfer voltage Vtr1 applied to transfer roller 10 is 0 V, it is the charge starting voltage Vth1 in a state not including the influence of positive charge injection in the transfer step. Meanwhile, since the charge starting voltage Vth2 calculated by Equation 2 is obtained when the transfer voltage Vtr2 applied to transfer roller 10 is 2500 V set as the reference voltage, it is the charge starting voltage Vth2 in a state including the influence of positive charge injection in the transfer step.

Refer back to FIG. 5.

(Processing of Step S13)

Figure 8:
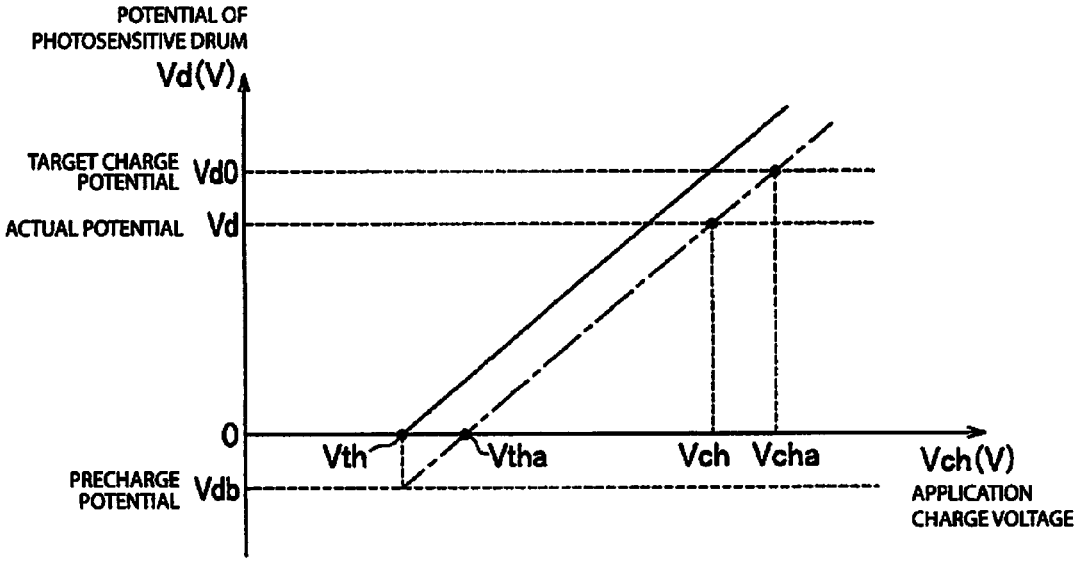
FIG. 8 is an explanatory view showing a difference between the application charge voltage of the image formation device according to the first embodiment and the application charge voltage of a general image formation device.

Next, in order to extract the influence of positive charge injection in the transfer step on the charge starting voltage, CPU 37 subtracts the charge starting voltage Vth2 calculated in step S12 from the charge starting voltage Vth1 also calculated in step S12. Then, CPU 37 calculates a charge starting voltage Vtha taking into account the influence of positive charge injection in the transfer step (step S13). FIG. 8 is an explanatory view showing a difference between the application charge voltage of the image formation device according to the first embodiment and the application charge voltage (called general application charge voltage below) of a general image formation device, where the abscissa indicates the application charge voltage Vch, and the ordinate indicates the potential of photosensitive drum 1. Hence, the processing of step S13 is described with reference to FIG. 8.

As shown in FIG. 8, the characteristic of the charge starting voltage Vtha corrected by including the influence of charge injection, indicated by alternate long and short dashed lines, is shifted in the positive direction of the application charge voltage Vch on the abscissa, relative to the characteristic of the general application charge voltage Vth before correction, indicated by a solid line. Thus, according to the correction in step S13, CPU 37 can calculate the charge starting voltage Vtha corrected by including the influence of positive charge injection in the transfer step, by Vtha=Vth1+(Vth1−Vth2).

Here, if the correction in step S13 is not made, the application start voltage is a precharge potential Vdb. Accordingly, since the charge voltage Vch is applied in the case of the characteristic of the general application charge voltage Vth before correction indicated by the solid line, the potential only rises to Vd (actual potential), and does not reach the target charge potential Vd0.

(Processing of Step S14)

Thereafter, CPU 37 calculates a charge voltage Vcha to be applied to charge roller 2 after correction (step S14). Here, CPU 37 calculates, by use of the corrected charge starting voltage Vtha calculated in the aforementioned step S13, the application charge voltage Vcha for charging photosensitive drum 1 to the target charge potential Vd0, according to Vcha=Vd0+Vtha.

Then, CPU 37 controls charge supply control circuit 31 to apply the charge voltage Vcha from charge supply 33 to charge roller 2 (step S15). Thus, the potential Vd of photosensitive drum 1 reaches the target charge potential Vd0. The warm-up operation of step S4 is ended, and step S5 of FIG. 4 is performed.

Next, to explain the superiority of image formation device 100 according to the first embodiment, a description is given of how to calculate a discharge starting voltage of a general image formation device as a comparative example (how to calculate a charge starting voltage of a general image formation device). FIG. 9 is an explanatory view showing a concept of calculating the charge starting voltage of the general image formation device, where the abscissa indicates the application charge voltage Vch, and the ordinate indicates the charge current Ich. FIG. 10 is an explanatory view showing a concept of calculating the application charge voltage of the general image formation device.

Figure 9:
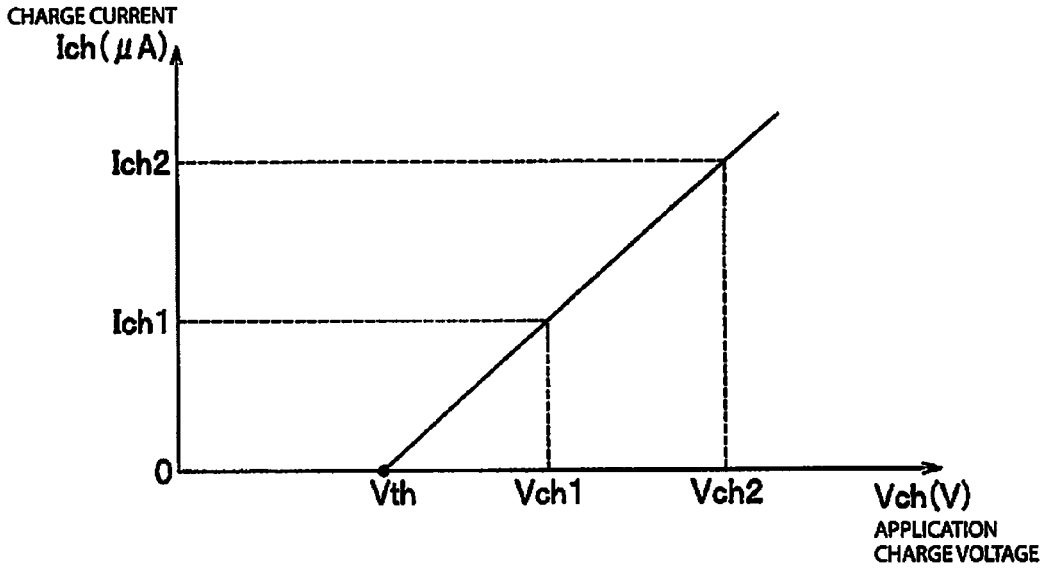
FIG. 9 is an explanatory view showing a concept of calculating the charge starting voltage of the general image formation device.

As in the case of image formation device 100 of the first embodiment, during the initial operation not including image formation in the warm-up operation of the image formation device, the general image formation device calculates the charge starting voltage Vth according to two different application charge voltages Vch1, Vch2 larger in absolute value than the charge starting voltage (about −550 V in the comparative example) in the normal state estimated from Paschen's Law, and the corresponding detected values of the charge currents Ich1, Ich2, as shown in FIG. 9. At this time, the image formation device of the comparative example sets the application charge voltages such that Vch1 is −1000 V, and Vch2 is −1350 V, while the transfer voltage is set to 0V.

Figure 10:
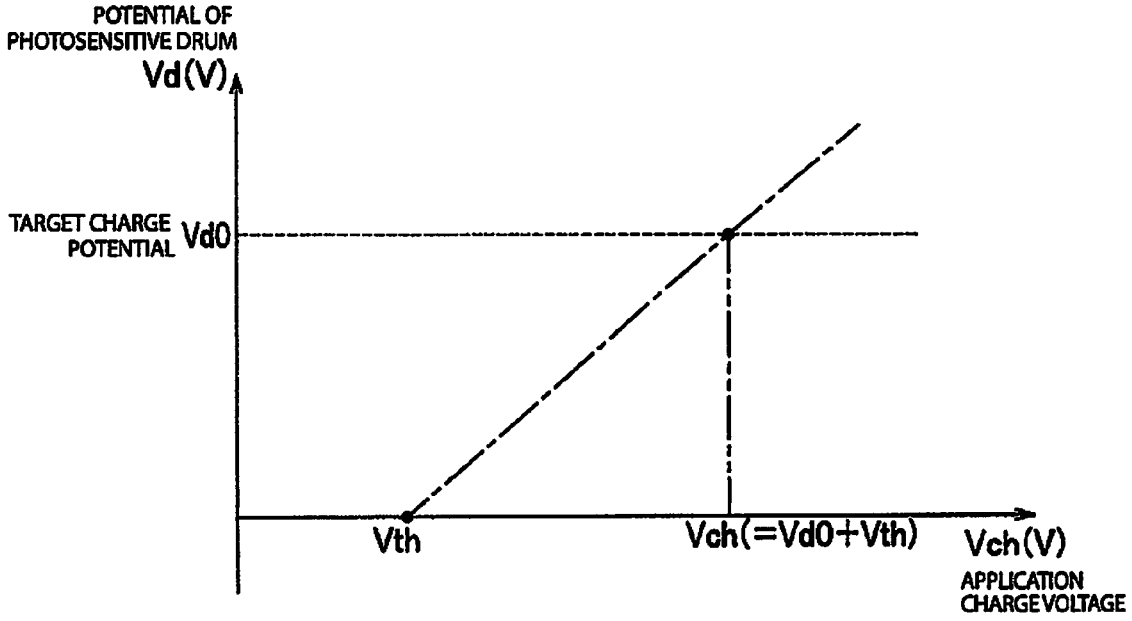
FIG. 10 is an explanatory view showing a concept of calculating the application charge voltage of the general image formation device.

Accordingly, as shown in the conceptual diagram in FIG. 10 showing how to calculate the application charge voltage Vch, the optimal application charge voltage Vch for charging the surface potential of photosensitive drum 1 to the target charge potential Vd0 is calculated according to Vch=Vd0+Vth, by using the charge starting voltage Vth calculated by a general method.

However, the above method of calculating the charge starting voltage Vth does not take into account that photosensitive drum 1 before the charge step is discharged, i.e., the influence of positive charge injection in the transfer step. For this reason, if, as in FIG. 8, the potential of photosensitive drum 1 (i.e., the precharge potential) before the charge step is Vdb due to the positive charge injection in the transfer step, applying the calculated application charge voltage Vch to the charge roller causes the surface potential of photosensitive drum 1 to become lower (Vch0) than the target charge potential Vd0.

The superiority of the invention over the above method is described in detail, by using an explanatory view of FIG. 11 which shows a difference between calculating the charge starting voltage in the first embodiment and in the comparative example. FIG. 11 shows a difference between charge potentials of photosensitive drums 1 of the first embodiment and of the comparative example. FIG. 11 is an example in which the target charge potential Vd0 of photosensitive drum 1 is set to −600 V, and shows the difference between the first embodiment and the comparative example in a case of measuring the charge potential of photosensitive drum 1 in a no-image region (a region on the surface of photosensitive drum 1 where no electrostatic latent image is formed) during actual printing.

In the calculation method of the first embodiment, when the target charge potential Vd0 is −600 V, the charge starting voltage Vth1 is −540 V, and the charge starting voltage Vth2 is −506 V, the application charge voltage Vch is calculated as −1174 V according to the following Equation 3.

$$\begin{aligned} Vch &= Vd0 + Vtha \qquad (3) \\ &= Vd0 + Vth1 + (Vth1 - Vth2) \\ &= (-600) + (-540) + \{(-540) - (-506)\} \\ &= -1174 \end{aligned}$$

On the other hand, in the calculation method of the comparative example, when the target charge potential Vd0 is −600 V and the charge starting voltage Vth is −540 V, the application charge voltage Vch is calculated as −1140 V according to Equation 4.

$$Vch = Vd0 + Vth \quad (4)$$
$$= (-600) + (-540)$$
$$= -1140$$

Here, the charge potentials of photosensitive drum 1 in the no-image regions are measured for the image formation devices of the first embodiment and of the comparative example during actual printing. As a result, the charge potential Vd of the first embodiment is −595 V, and the charge potential Vd of the comparative example is −561 V. Hence, as shown in FIG. 11, the difference between the target charge potential Vd0=−600 V and the charge potential Vd of photosensitive drum 1 during printing is −5 V in the case of the first embodiment, and −39 V in the case of the comparative example. In other words, by using the calculation method of the first embodiment, it is possible to charge photosensitive drum 1 closer to −600 V which is the target charge potential of photosensitive drum 1, and thereby to more accurately control the charge voltage to be applied to photosensitive drum 1.

Note that if a supply voltage applied to transfer roller 10 in the transfer step is higher than +550 V in the normal state, image formation device 100 may perform discharging and inject positive charges (positive current) to photosensitive drum 1, such that the surface potential of photosensitive drum 1 is positively charged. Here, if the surface potential of photosensitive drum 1 is negatively charged, discharge lamp 23 can discharge the surface potential of photosensitive drum 1 to 0 V. However, if the surface potential of photosensitive drum 1 is positively charged, discharge lamp 23 cannot perform discharging, and thus the surface potential of photosensitive drum 1 stays in the positive state. Accordingly, when proceeding to the transfer step with the surface potential of photosensitive drum 1 positively charged (e.g., +100 V), image formation device 100 performs discharging when the application charge voltage of charge roller 2 is −450 V. In other words, image formation device 100 changes the discharge starting voltage (charge starting voltage).

As described, image formation device 100 according to the first embodiment enables more accurate calculation of the optimal application charge voltage even in a state where the charge potential of photosensitive drum 1 immediately before the charge step is not 0 V due to the influence of a positive charge injection in the transfer step. As a result, image formation device 100 of the first embodiment can prevent problems, such as a variation in the density of the print image and toner 22 being transferred onto portions which originally should be blank, and can thereby maintain a favorable print quality.

<Second Embodiment>

[Operation of Image Formation Device 100]

Since the configuration of image formation device 100 of a second embodiment is the same as that of image formation device 100 of the first embodiment, redundant descriptions are omitted. By use of image formation device 100 of the second embodiment, a description is given of how to correct an application charge voltage Vch0 preset in the normal state so as to obtain a target charge potential Vd0 of photosensitive drum 1, under influences such as wear of a film thickness of photosensitive drum 1. assumable from environmental conditions and usage of recording medium 20 (sheet), for example. Specifically, image formation device 100 of the second embodiment is configured to correct the application charge voltage Vch0 to thereby calculate a more accurate application charge voltage.

Generally, in image formation device 100 as shown in FIG. 1, for example, application charge voltages Vch0 in the normal state are set for film thicknesses of photosensitive drum 1 estimated based on the temperature detected by a thermal sensor and the counted number of printed recording media 20, and charge starting voltages Vth0 are set for the respective application charge voltages Vch0. In addition, as shown in FIG. 9, image formation device 100 calculates a charge starting voltage Vth for photosensitive drum 1 according to two different application charge voltages Vch1, Vch2, larger in absolute value than the charge starting voltage in the normal state which is estimated from Paschen's Law, and corresponding detected values of charge currents Ich1, Ich2. Alternatively, image formation device 100 gradually varies the application charge voltage Vch, and estimates, as the charge starting voltage Vth, the application charge voltage Vch at which charge current detector 35 shown in FIG. 3 detects a flow of the charge current Ich.

Figure 12:
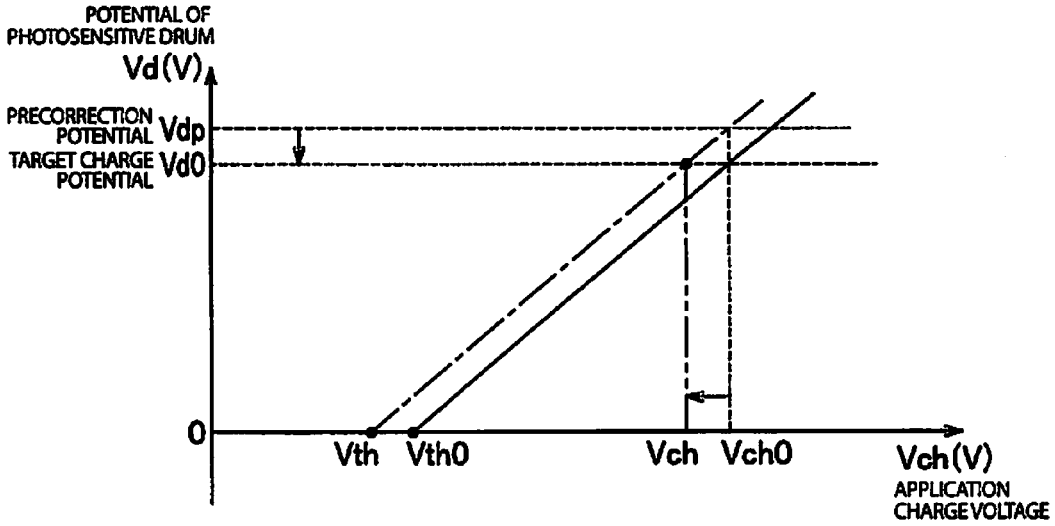
FIG. 12 is an explanatory view showing a concept of correcting the application charge voltage of the general image formation device.

In other words, as in an explanatory view of FIG. 12 showing a concept of correcting the application charge voltage in a general image formation device, image formation device 100 calculates the corrected application charge voltage Vch from the difference between the charge starting voltages Vth0 and Vth in the normal state, according to a relational expression of the corrected application charge voltage Vch=Vch0+(Vth0−Vth). Note that in FIG. 12, the abscissa indicates the application charge voltage Vch and the ordinate indicates the potential Vd of the photosensitive drum.

Figure 13:
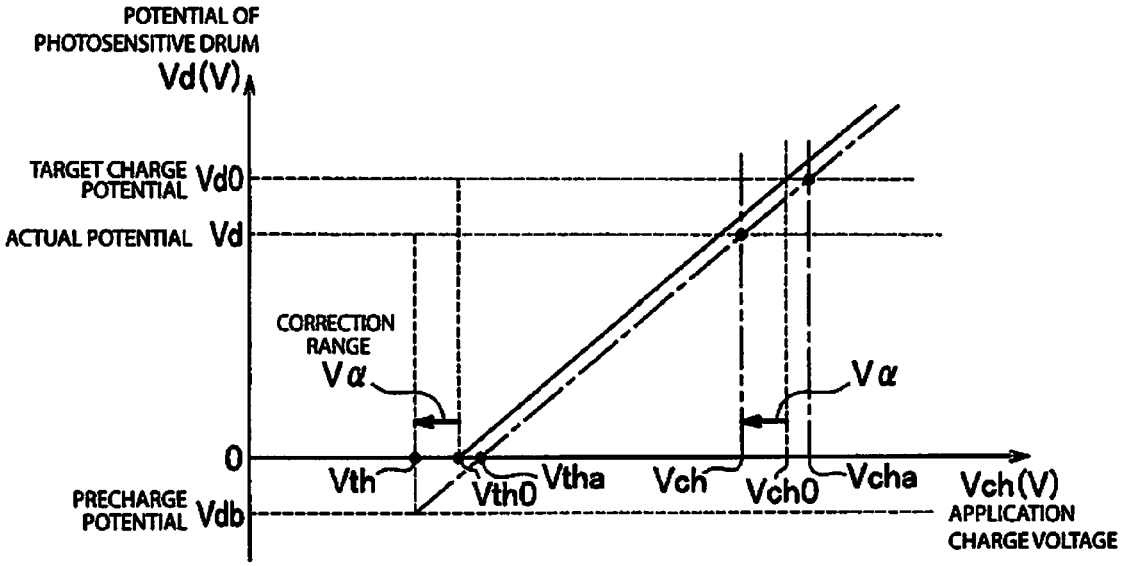
FIG. 13 is an explanatory view showing a concept of correcting the application charge voltage of the image formation device according to the first embodiment.

However, in the method above that does not take into account the influence of positive charge injection in the transfer step, if the influence of positive charge injection in the transfer step, which varies depending on environmental conditions, film thickness of photosensitive drum 1 and the like, is large, the actual charge potential Vd becomes smaller than the target charge potential Vd0. To be specific, as in an explanatory view of FIG. 13 showing a concept of correcting the application charge voltage in the second embodiment, if image formation device 100 corrects the application charge voltage Vch0 with a correction range Vα (=Vth0−Vth) of the charge starting voltage, the actual charge potential Vd becomes smaller than the target charge potential Vd0. For this reason, image formation device 100 of the second embodiment approximates the actual charge potential Vd to the target charge potential Vd0 in the following manner.

Figure 14:
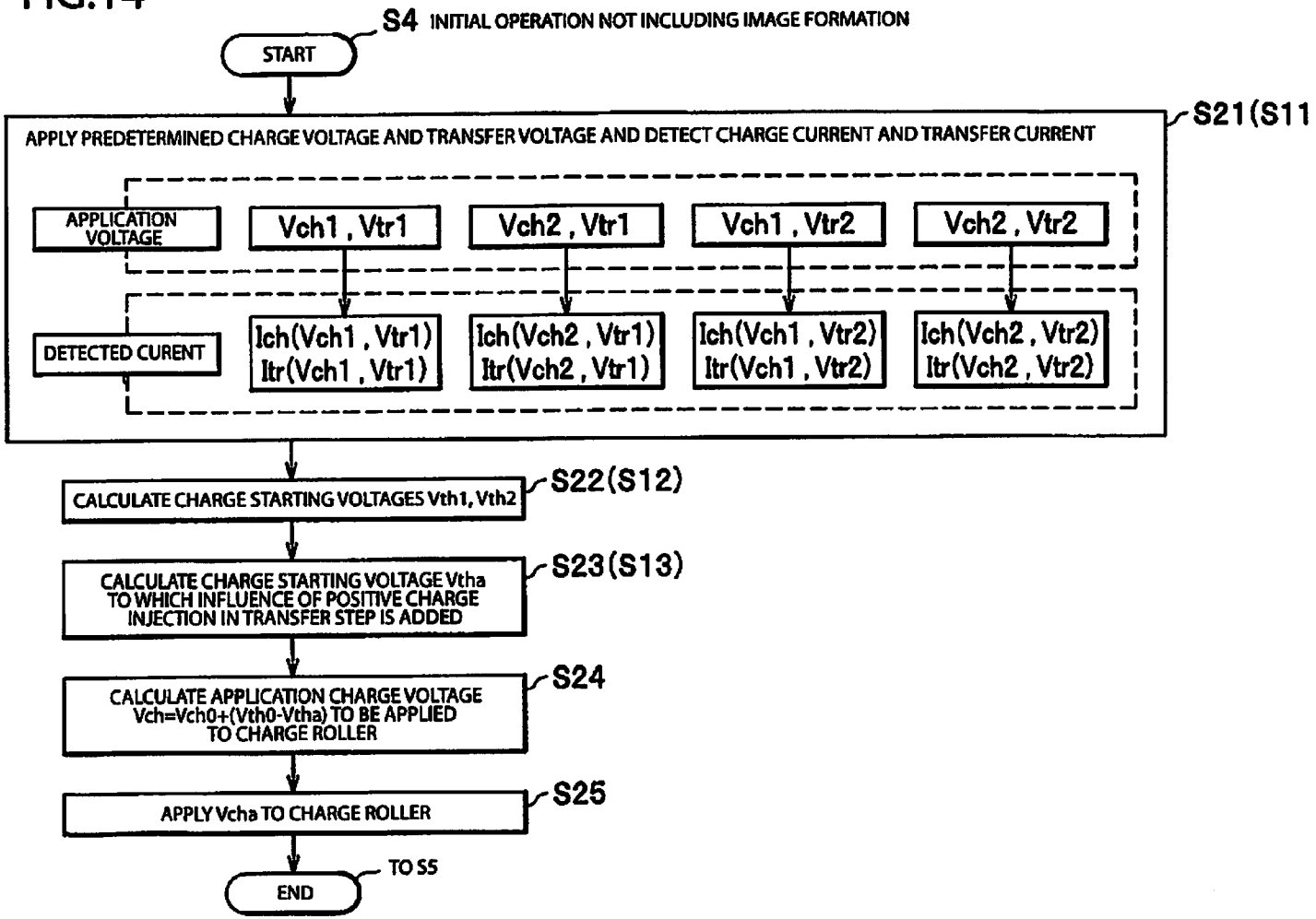
FIG. 14 is a flowchart showing a flow of a control operation of an image formation device according to a second embodiment.

FIG. 14 is a flowchart showing a flow of a control operation of image formation device 100 according to the second embodiment. Specifically, FIG. 14 shows a flow of the control operation of image formation device 100 according to the second embodiment for calculating the optimal application charge voltage. Preconditions for an initial operation not including image formation of image formation device 100 according to the second embodiment, and contents of operations of steps S21 to 23 of FIG. 14 are the same as the contents of operations of steps S 11 to 13 of FIG. 5 described in the first embodiment, and thus redundant descriptions are omitted.

(Processing of Step S24)

After step S23 (step S13), CPU 37 of image formation device 100 according to the second embodiment calculates the charge voltage Vch to be applied to charge roller 2 after correction (step S24). Here, CPU 37 calculates the application charge voltage Vch by use of the application charge voltage Vch0 preset in the normal state (normal application charge voltage), the charge starting voltage Vth0 in the normal state (normal charge starting voltage), and the corrected charge starting voltage Vtha calculated in the aforementioned step S23, according to Vch=Vch0+(Vth0−Vtha). In short, the correction range Vα of the application charge voltage Vch is (Vth0−Vtha).

Then, CPU 37 controls charge supply control circuit 31 to apply the charge voltage Vch from charge supply 33 to charge roller 2 (step S25). Thus, the charge potential Vd of photosensitive drum 1 reaches the target charge potential Vd0. The warm-up operation of step S4 is ended, and step S5 of FIG. 4 is performed.

FIG. 15 is an explanatory view showing a difference in correction of the application charge voltages in the second embodiment and in a comparative example, and shows the difference in the application charge voltage of photosensitive drum 1 attributable to the correction made in the application charge voltage. As shown in FIG. 15, image formation device 100 of the second embodiment and a general image formation device of the comparative example are used, under a high-temperature and high-humidity environment (abbreviated as HH), a normal-temperature and normal-humidity environment (abbreviated as NN), and a low-temperature and low-humidity environment (abbreviated as LL) in both cases. The film thicknesses of photosensitive drum 1 are 22 μm and 14 μm. The surface potential (charge potential) of photosensitive drum 1 is measured in the no-image region during actual printing, after correcting the application charge voltage Vch0 and the charge starting voltage Vth0 preset under the respective environments.

As can be seen from FIG. 15, for example, the difference between the charge potential Vd and the target charge potential Vd0 under environment HH with the film thickness of 22 μm is +11 V in the second embodiment (example), and −58 V in the comparative example; under environment NN with the film thickness of 14 μm is +5 V in the second embodiment and −25 V in the comparative example; and under environment LL with the film thickness of 22 μm is −12 V in the second embodiment and −53 V in the comparative example.

Thus, according to image formation device 100 of the second embodiment, it is possible to correct the application charge voltage so as to obtain the target charge potential Vd0=−600 V of photosensitive drum 1 with higher accuracy than the image formation device of the comparative example, under any environment with any film thickness of photosensitive drum 1.

As described, image formation device 100 according to the second embodiment has application charge voltages corresponding to estimated film thicknesses of photosensitive drum 1 preset therein. The preset film thicknesses are estimated on the basis of environmental conditions detected by a built-in thermal sensor (not shown), a built-in humidity sensor (not shown), and the like, and information such as the number of printed recording media 20. By using this application charge voltage, it is possible to perform a correction to set an optimal charge potential for photosensitive drum 1 without having to check the temperature or film thickness, even when a change occurs in the environment during an actual continuous printing process. Accordingly, image formation device 1 according to the second embodiment is capable of correcting the application charge voltage with higher accuracy than a general image formation device or image formation device 100 according to the first embodiment. As a result, image formation device 100 according to the second embodiment can suppress problems in printing, such as variation in the density of the print image and toner 22 being transferred onto portions which originally should be blank, even when changes occur in environmental conditions, and can thereby maintain a favorable print quality.

<Summary>

As described, image formation devices 100 according to the first and second embodiments use at least two transfer voltages (e.g., 0 V and 2500 v) to estimate an applied charge starting voltage in the actual use state, and apply the estimated charge voltage from the transfer roller to photosensitive drum 1. Accordingly, image formation devices 100 according to the first and second embodiments can modify variation in the surface potential of photosensitive drum 1 due to changes in the environment, such as the temperature in the actual use state, and thus can maintain a favorable print quality.

Specific description is given above of embodiments of image formation device 100 according to the first and second embodiments. However, the invention is not limited to contents of the aforementioned embodiments, and various changes can be made without departing from the gist of the invention, as a matter of course. In addition, the invention is also applicable to an image formation program implementing the functions of image formation device 100 described in the embodiments above.

The invention is capable of regularly maintaining favorable print quality, and thus can be effectively used in image formation device 100 using an electrophotographic process, such as a copying machine, a printer, a facsimile, and an MFP (Multi Function Printer).

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation device for forming an image by an electrophotographic process forming a latent image on a surface of a photoreceptor charged by a charge member, attaching a developer to the latent image on the surface of the photoreceptor to form a developer image, and then transferring the developer image from the photoreceptor to a medium, the image formation device comprising:

a charge voltage controller configured to control an application charge voltage to be applied to the charge member;

a transfer voltage controller configured to control a transfer voltage to be applied to a transfer member;

a charge current detector configured to detect a charge current flowing through the charge member; and a controller configured to determine the application charge voltage according to the application charge voltage and the detected charge current both detected when the transfer voltage controller applies a predetermined transfer voltage, wherein the controller is configured to:

estimate a first charge starting voltage comprising an application charge voltage at which a charge current flowing through the charge member is lowered to zero with the transfer voltage being a first transfer voltage, estimate a second charge starting voltage comprising an application charge voltage at which a charge current flowing through the charge member is lowered to zero with the transfer voltage being a second transfer voltage, and determine an application charge voltage to be applied to the charge member by adding up the first charge starting voltage, a target charge potential of the photoreceptor, and a difference between the first and second charge starting voltages.

2. An image formation program causing a computer of an image formation device to form an image by an electrophotographic process, the image formation device including a photoreceptor, a charge member, an exposure unit, a development unit, a transfer member, a charge voltage controller configured to control an application charge voltage to be applied to the charge member, a transfer voltage controller configured to control a transfer voltage to be applied to the transfer member, and a charge current detector configured to detect a charge current flowing through the charge member, the program causing the computer to execute:

a first charge starting voltage estimation step of estimating a first charge starting voltage as an application charge voltage at which a charge current flowing through the charge member is lowered to zero in a case where the transfer voltage is a first voltage;

a second charge starting voltage estimation step of estimating a second charge starting voltage as an application charge voltage at which a charge current flowing through the charge member is lowered to zero in a case where the transfer voltage is a second voltage; and an application charge voltage determination step of determining an application charge voltage to be applied to the charge member by adding up the first charge starting voltage, a target charge potential of the photoreceptor, and a difference between the first and second charge starting voltages.

3. The image formation program according to claim 2, wherein the program causing the computer to execute the first charge starting voltage estimation step and the second charge starting voltage estimation step, comprises acquiring: two or more different application charge voltages applied to the charge member, and detected charge currents detected by the charge current detector for the application charge voltages, and estimating, based on a linear relationship between the application charge voltages and the charge currents, the application charge voltage at which the charge current flowing through the charge member is lowered to zero, using two or more combinations of the application charge voltages and the detected charge currents.

4. The image formation program according to claim 3, wherein the application charge voltage determination step includes:

determining the application charge voltage to be applied to the charge member as a value obtained by adding a normal application charge voltage to a difference between a normal charge starting voltage and the second charge starting voltage, wherein the normal application charge voltage is obtained by correcting the target charge potential, by taking into account a film thickness of the photoreceptor under a normal environment, and the normal charge starting voltage is the application charge voltage at which the charge current flowing through the charge member is lowered to zero in a case where the transfer voltage under the normal environment is the first voltage.

5. An image formation device for forming an image by an electrophotographic process forming a latent image on a surface of a photoreceptor charged by a charge member, attaching a developer to the latent image on the surface of the photoreceptor to form the developer image, and then transferring the developer image from the photoreceptor to a medium, the image formation device comprising:

a charge voltage controller configured to control an application charge voltage to be applied to the charge member;

a transfer voltage controller configured to control a transfer voltage to be applied to a transfer member;

a charge current detector configured to detect a charge current flowing through the charge member; and a controller configured to determine the application charge voltage according to the application charge voltage and the detected charge current both detected when the transfer voltage controller applies a predetermined transfer voltage, wherein the controller is configured to determine the application charge voltage according to two or more DC voltages of different values applied to the charge member and according to two or more DC voltages of different values applied to the transfer member.

6. The image formation device according to claim 5, further comprising a transfer current detector configured to detect a current flowing through the transfer member, wherein the controller is configured to acquire the application charge voltage and the detected charge current, according to values of two or more currents flowing through the charge member and detected by the charge current detector when the two or more DC voltages of different values are applied to the charge member, and according to values of two or more currents flowing through the transfer member and detected by the transfer current detector when the two or more DC voltages of different values are applied to the transfer member.

7. The image formation device according to claim 6, wherein the controller is configured to calculate the application charge voltage by use of a value of a current detected by the charge current detector when the two or more DC voltages are applied to the charge member, and a value of a current detected by the transfer current detector when the two or more DC voltages are applied to the transfer member.

8. The image formation device according to claim 7, wherein in an initial operation not including image formation, at least one of voltages applied to the transfer member is 0 V.

9. The image formation device according to claim 6, wherein in an initial operation not including image formation, at least one of two or more DC voltages applied to the transfer member is 0 V.

10. The image formation device according to claim 6, wherein the controller is configured to correct the application charge voltages for respective preset environments by use of a value of a current detected by the charge current detector when the two or more DC voltages are applied to the charge member, and a value of a current detected by the transfer current detector when the two or more DC voltages are applied to the transfer member.

11. The image formation device according to claim 5, wherein the controller is configured to:

apply two or more different application charge voltages to the charge member and acquire detected charge currents detected by the charge current detector for the application charge voltages, and estimate, based on a linear relationship between the application charge voltages and the charge currents, the application charge voltage at which the charge current flowing through the charge member is lowered to zero, by using two or more combinations of the application charge voltages and the detected charge currents.

12. The image formation device according to claim 11, wherein the controller is configured to determine the application charge voltage as a value obtained by adding a normal application charge voltage to a difference between a normal charge starting voltage and the second charge starting voltage, wherein the normal application charge voltage is corrected to obtain the target charge potential by taking into account a film thickness of the photoreceptor under a normal environment, and the normal charge starting voltage comprises the application charge voltage at which the charge current flowing through the charge member is lowered to zero, where the transfer voltage under the normal environment is the first voltage.

* * * * *